United States Patent [19]

Feldkämper

[11] 4,434,948

[45] Mar. 6, 1984

[54] APPARATUS FOR PRODUCING OVERLAPPING BAND ROLLS FROM SUPERPOSED OVERLAPPING FLAT WORKPIECES

[75] Inventor: Richard Feldkämper, Lengerich of Westphalia, Fed. Rep. of Germany

[73] Assignee: Windmoller & Holscher, Lengerich, Fed. Rep. of Germany

[21] Appl. No.: 302,689

[22] Filed: Sep. 15, 1981

[30] Foreign Application Priority Data

Sep. 17, 1981 [DE] Fed. Rep. of Germany ..... 3035114

[51] Int. Cl.[3] ..... B65B 63/04; B65H 17/02; B65H 5/02

[52] U.S. Cl. ..... 242/59; 242/67.1 R; 271/275; 53/118

[58] Field of Search ..... 242/59, 67.1 R, 67.3 R, 242/65, 75.1; 221/277; 271/275, 276, 277; 53/117, 118, 119

[56] References Cited

U.S. PATENT DOCUMENTS

| | | | |
|---|---|---|---|
| 402,551 | 4/1889 | Winn | 242/59 |
| 789,707 | 5/1905 | Bellamy | 242/59 |
| 4,000,864 | 1/1977 | Kurtz | 242/59 |

*Primary Examiner*—Stuart S. Levy
*Assistant Examiner*—Lloyd D. Doigan
*Attorney, Agent, or Firm*—Fleit, Jacobson, Cohn & Price

[57] ABSTRACT

In an apparatus for coiling flat workpieces arriving in overlapping formation on a conveyor onto a winding core to form a reel of overlapping workpieces, a pivoted frame carrying rollers for an endless driven belt is mounted so that the belt lies initially against the winding core and then against the convolutions of workpieces being coiled thereon. The frame is mounted on a pivot shaft which subdivides the frame into differently long lever arms, each carrying a roller for the belt. The ends of the winding core are mounted in parallel guides extending substantially along imaginary lines passing through the winding core axis and the axis of the roller on the shorter lever arm.

5 Claims, 1 Drawing Figure

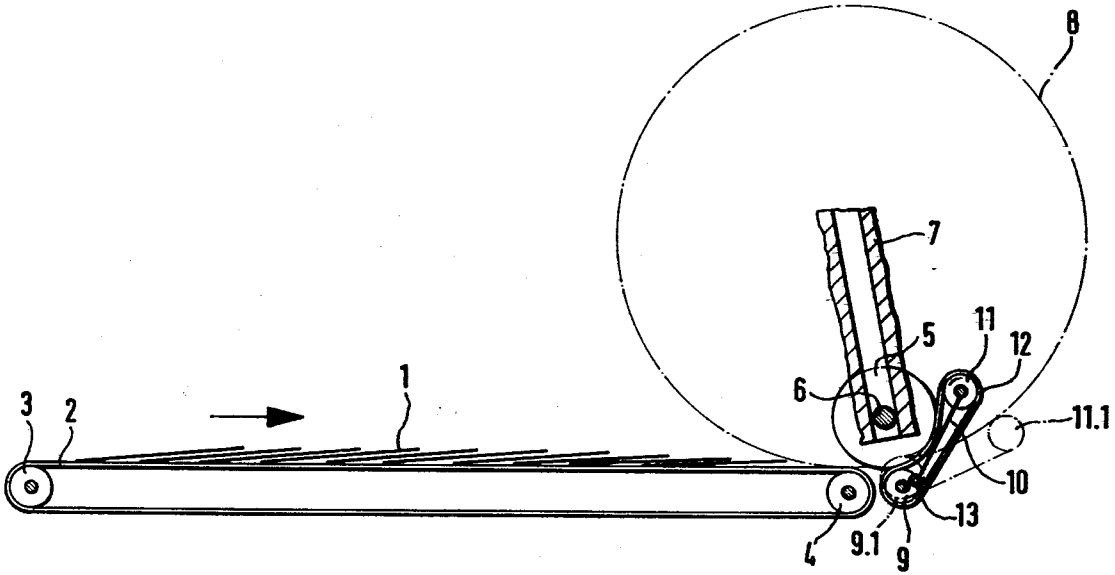
8
11.1
12
11
10
13
7
5
9
9.1
6
4
1
2
3

APPARATUS FOR PRODUCING OVERLAPPING BAND ROLLS FROM SUPERPOSED OVERLAPPING FLAT WORKPIECES

The invention relates to an apparatus for producing overlapping band rolls from superposed overlapping flat sacks, bags or like flat workpieces, comprising a winding core which is held in the machine stand and on which at least one holding tape is secured that is withdrawn from a supply reel mounted in the stand and that, during coiling of the overlapping workpieces, is tightened to hold same from above, a pivotable frame which carries rollers at least at opposite ends and is disposed downstream of the conveyor means for delivering the workpieces, and a driven endless conveyor belt which passes over the rollers and lies against the freely rotatable winding core or the overlapping band roll being formed thereon.

In the apparatus according to Parent patent application P 25 44 135.4-27, at first the winding core and subsequently the overlapping band roll being formed thereon is driven by way of the conveyor belt of the frame that can be applied thereto so that the specific pressure exerted by the conveyor belt onto the overlapping band roll decreases as the diameter of the overlapping band roll increases. As a consequence of this known manner of coiling of overlapping band rolls, the latter become increasingly loose radially outwardly.

It is therefore the object of the invention to improve the apparatus according to the parent application so that a substantially uniform specific pressure is achieved during coiling of the individual layers of the overlapping band roll.

According to the invention, this object is achieved in the apparatus according to the parent application in that the frame is mounted on a pivot shaft in the machine stand that divides the frame into a longer and a shorter lever arm, and in that the ends of the winding core are held in parallel guides extending substantially along lines drawn through the axes of the winding core and the roller which is mounted at the end of the shorter lever arm and which supports the winding core or the overlapping band roll being formed. In the apparatus according to the invention, the overlapping band roll being formed progressively swings the longer lever arm outwardly as the diameter of the overlapping band roll increases, so that the roller mounted on the shorter lever arm is pressed against the overlapping band roll with a correspondingly increasing pressure. In this way, the specific pressure exerted on the outermost layer of the overlapping band roll can be kept substantially constant during coiling so that the outer convolutions of the overlapping band roll are wound up substantially just as tightly as the inner convolutions.

Desirably, the shorter lever arm pointing to the conveyor means delivering the workpieces and the longer lever arm of the frame are angled relatively to each other towards the winding core so that the pressure exerted on the periphery of the overlapping band roll being formed can be adjusted.

The endmost direction-changing roller of the delivering conveyor means and the roller mounted on the shorter lever arm may be separated by a narrow gap so that, as the diameter of the overlapping band roll increases, the endmost direction-changing roller of the conveyor means supports the roll to an increasing extent.

Further advantageous embodiments of the invention have been described in claims 4 and 5. One example of the invention will now be described in more detail with reference to the drawing in which the single FIGURE is a diagrammatic side elevation of the apparatus for producing overlapping band rolls.

The conveyor belt 2 which passes over the rollers 3 and 4, of which one is provided with a drive (not shown), supplies the overlappingly superposed sacks 1 which are to be wound up to form an overlapping band roll 8. The direction-changing roller 4 is, as shown, disposed closely beneath the winding core 5 of the overlapping band roll 8 to be formed. The stub axles 6 of the winding core 5 are loosely guided in slideways 7 which, as shown, are slightly inclined to the left so that the winding core 5 of the finally coiled overlapping band roll 8 lies substantially above the axis of the direction-changing roller 4. In front of the direction-changing roller 4, a roller 9 is freely rotatably mounted on the shorter arm of a bell crank lever 10. A roller 11 is rotatably mounted at the end of the longer arm of the bell crank lever 10 which is in the form of a frame. An endless belt 12 provided with a drive (not shown) passes over the rollers 9, 11.

The two arms of the bell crank lever 10 are so dimensioned and angled towards each other that about one quarter of the winding core 5 is enveloped by the belt 12 and the roller 11 does not touch the winding core 5. The bell crank lever 10 is pivoted about a shaft 13 fixed with respect to the stand and this shaft sub-divides the lever into a shorter lever arm carrying the roller 9 and a longer lever arm carrying the roller 11. During coiling of the overlapping sacks and increasing diameter of the overlapping band roll 8, the roller 11 will also progressively come into contact with the periphery of the overlapping band roll 8. The roller 11 is finally swung to the position 11.1. The roller 9 thereby reaches the position 9.1 shown in broken lines. Pivoting of the roller 9 about the shaft 13 causes it to exert on the overlapping band roll 8 a pressure which, corresponding to the progress of coiling, continuously increases the specific pressure exerted on the periphery of the overlapping band roll being formed, so that the outer layers of the overlapping band roll 8 are coiled as tightly as the inner layers. By means of this coiling of the overlapping band roll with substantially uniform tightness, the outer layers are prevented from slipping off telescopically.

I claim:

1. Apparatus for producing overlapping band rolls from superposed overlapping flat sacks, bags or like flat workpieces, comprising: a freely rotatable winding core, a conveyor means, a pivotable frame which carries rollers at least at opposite ends and is disposed downstream of the conveyor means for delivering the workpieces, and a driven endless conveyor belt which passes over the rollers and lies against the freely rotatable winding core or the overlapping band roll being formed thereon, characterised in that the frame is mounted on a pivot shaft that divides the frame into a longer and a shorter lever arm, and in that the ends of the winding core are held in parallel guides extending substantially along lines drawn through the axes of the winding core and the roller which is mounted at the end of the shorter lever arm and which supports the winding core or the overlapping band roll being formed.

2. Apparatus according to claim 1, characterised in that the shorter lever arm pointing to the conveyor means delivering the workpieces and the longer lever arm of the frame are angled relatively to each other towards the winding core.

3. Apparatus according to claim 1 or claim 2, characterised in that the endmost direction-changing roller of the delivering conveyor means and the roller mounted on the shorter lever arm are separated by a narrow gap.

4. Apparatus according to claims 1 or 2, characterised in that the guides are so inclined in the machine stand towards the delivering conveyor means that the winding core of the finally coiled overlapping band roll is disposed substantially vertically above the endmost direction-changing roller of the delivering conveyor means.

5. Apparatus according to claims 1 or 2, characterised in that the longer lever arm has a length such that the roller at the end thereof comes to lie against the periphery of the overlapping band roll as the diameter thereof increases.

* * * * *